US005468348A

United States Patent [19]

Blackledge et al.

[11] Patent Number: 5,468,348

[45] Date of Patent: Nov. 21, 1995

[54] MULTI-PLY WEB FORMER AND METHOD

[75] Inventors: James Blackledge, Leyland, England; Nazzareno Salvai, Turin, Italy; James A. Turner, Wigan, England

[73] Assignee: Beloit Technologies, Inc., Wilmington, Del.

[21] Appl. No.: 306,844

[22] Filed: Sep. 14, 1994

Related U.S. Application Data

[63] Continuation of Ser. No. 960,378, Jan. 4, 1993, abandoned.

[30] Foreign Application Priority Data

Jul. 10, 1990 [EP] European Pat. Off. ..... 90113178

[51] Int. Cl.[6] ..... D21F 11/04

[52] U.S. Cl. ..... 162/132; 162/133; 162/303; 162/304

[58] Field of Search ..... 162/123, 132, 162/133, 203, 300, 301, 303, 304

[56] References Cited

U.S. PATENT DOCUMENTS

| | | | |
|---|---|---|---|
| 3,578,559 | 5/1971 | Beck | 162/303 |
| 3,582,467 | 6/1971 | Gustafson et al. | 162/303 |
| 3,607,625 | 9/1971 | Hill et al. | 162/343 |
| 3,726,758 | 4/1973 | Parker et al. | 162/299 |
| 3,876,498 | 4/1975 | Justus | 162/199 |
| 3,884,756 | 5/1975 | Gustafson | 162/299 |
| 3,985,612 | 10/1976 | Watanabe | 162/303 |
| 3,994,774 | 11/1976 | Holme et al. | 162/352 |
| 4,153,504 | 5/1979 | Justus | 162/133 |
| 4,154,645 | 5/1979 | Kankaanpää | 162/133 |
| 4,216,056 | 8/1980 | Nykopp | 162/300 |
| 4,523,978 | 6/1985 | Pullinen | 162/301 |
| 4,609,435 | 9/1986 | Tissari | 162/352 |
| 4,830,709 | 5/1989 | Turner et al. | 162/304 |
| 4,894,120 | 1/1990 | North | 162/301 |

FOREIGN PATENT DOCUMENTS

| | | | |
|---|---|---|---|
| 136000 | 4/1985 | European Pat. Off. | 162/301 |
| 2072936 | 9/1971 | France . | |
| 2388936 | 4/1977 | France . | |
| 2418298 | 2/1978 | France . | |
| 1336713 | 11/1973 | United Kingdom . | |

*Primary Examiner*—Karen M. Hastings

*Attorney, Agent, or Firm*—Dirk J. Veneman; Raymond W. Campbell; Gerald A. Mathews

[57] ABSTRACT

A multi-ply paper web is formed by bringing a top ply liner into ply-bonding engagement with a base ply web ($W_B$) traveling on a base ply forming wire (36). The top ply liner ($W_T$) is formed between two co-running forming wires (10, 20) in a convex upwardly/concave downwardly curved, substantially horizontal forming zone. Dewatering in the forming zone is effected by applying sub-atmospheric air pressure solely beneath the lower surface of the top ply liner ($W_T$) being formed. Water is removed from the upper surface of the top ply liner ($W_T$) solely by wire tension, gravity and centrifugal force created by passing the co-running forming wires (10, 20) over the convex upwardly curved path of travel. This permits a greater concentration of pulp stock fines to remain in the upper surface of the top ply liner ($W_T$) to effect greater ply-bonding affinity with the base ply ($W_B$) when the two plies ($W_T$, $W_B$) are brought together and bonded.

2 Claims, 3 Drawing Sheets

MULTI-PLY WEB FORMER AND METHOD

This is a continuation of application Ser. No. 07/960,378 filed on Jan. 4, 1993, now abandoned.

BACKGROUND OF THE INVENTION

1. Field of the Invention

This invention relates to multi-ply paper formation. More specifically, this invention relates to two-wire, multi-ply paper formation. Still more particularly, this invention relates to two-wire, multi-ply web formation wherein the outer ply to be ply-bonded to the base ply of the multi-ply web, has its surface dewatered essentially by wire tension and centrifugal force.

1. Description of the Prior Art

In prior forming arrangements for forming a multi-ply paper web product, a relatively coarse base ply is first produced and a second, outer ply is produced to be brought into ply-bonding contact with the previously formed base ply. The outer ply, which is intended to form the outer surface of a printed container, such as a box, is formed of a finer grade of pulp stock so as to provide a smoother, higher quality surface. In order to form the outer ply at commercially desirable speeds, dewatering was effected through both of its surfaces before the outer ply was brought into ply-bonding contact with the base ply of the paper web sheet. This produces an acceptable paper product, mainly due to the quality of the pulp stock used to produce the outer ply, but the requirements of producing a better product with cheaper pulp, and the need to produce a better product at higher speeds regardless of pulp quality, or a combination of both, have necessitated the conception of an improved multi-ply web former having an outer surface which exhibits the desired printability, and feel and visual smoothness while having an inner surface which has better ply-bonding characteristics.

In prior apparatus, both sides of the outer ply were dewatered positively, that is, they were dewatered by the application of sub-atmospheric air pressure directly to both surfaces to enhance the removal of water through both of the web surfaces. When both surfaces are positively dewatered, fines and fillers in the pulp stock are urged outwardly in both directions to the respective surfaces of the web and removed during the dewatering process. Thus, while the web is rapidly dewatered, which was the desired effect, the fines and fillers which contribute so much to the ply bonding characteristics of the outer side of the web produced, were removed in large quantities which deleteriously effected web quality as well.

SUMMARY OF THE INVENTION

The aforementioned shortcomings, deficiencies and characteristics of the outer ply in a ply-bonded multi-ply paper web, and the resultant multi-ply paper product, have been obviated by this invention.

In this invention, the outer ply of a multi-ply web, which is sometimes referred to as a "white top liner", is produced by dewatering through one side of the web using only centrifugal force and the force of the tension of the forming wire over the web. The outer ply is formed in the general direction opposite to the direction of the traveling base ply to which it is ply bonded. The generally upwardly facing surface of the top ply is dewatered by the tension of its contact with the outer surface of the looped upper, outer forming wire the outer surface being arrayed concave downwardly as viewed from the outer side of the web over the forming zone, and held over the web which has been formed by the aqueous pulp stock slurry projected between the outer and inner forming wires. In addition, one, or more, water collection devices, such as water skimming slots, which may or may not be assisted by a vacuum, assist in removing water expressed inwardly of the outer forming wire. The fines and fillers in the pulp stock slurry are thus exposed to sub-atmospheric (vacuum) pressure only within the looped lower forming wire the inner surface of which is disposed in a generally concave downward direction over the forming zone for a relatively long distance. This affects the rate of water removal as well as permits the retention of a greater proportion of fines and fillers in the web, particularly the top surface of the web, due to the fact that migration of the fines and fillers through the lower surface of the web is hindered by the web fibers. The downwardly directed, relatively gentle dewatering through the lower surface of the outer web ply is effected by subjecting the ply to a sub-atmospheric pressure over a relatively long dewatering zone, which can take the form of a vacuum or suction box, or a plurality of spaced foil blades, or a combination of both.

Accordingly, it is an object of this invention to provide a method and apparatus for producing a multi-ply paper sheet having improved ply-bond characteristics.

Another object of this invention is to provide a method and apparatus for producing the outer ply of a multi-ply paper sheet wherein the surface to be ply-bonded is dewatered solely by centrifugal force, wire tension and gravity.

A feature and advantage of this invention is the provision of a white top liner in a multi-ply paper sheet, which sheet can be produced at improved speeds while exhibiting improved ply-bonding characteristics and a commercially desirable outer surface.

These and other objects, features and advantages of the invention will become readily apparent to those skilled in the art upon reading the following description of the preferred embodiments in conjunction with the attached drawings.

DESCRIPTION OF THE PREFERRED EMBODIMENTS

The convention used to describe the wires is always with reference to both sides of the same forming wire. Thus, for example, if the upper surface is described as convex upwardly, like , then the lower surface of the same forming wire in the same position is concave downwardly, like .

By the same convention, the opposite is also true. Thus, if the upper surface of a forming wire is concave upwardly, like ⌣, then the lower surface is convex downwardly, like ⌣.

Figure 1:
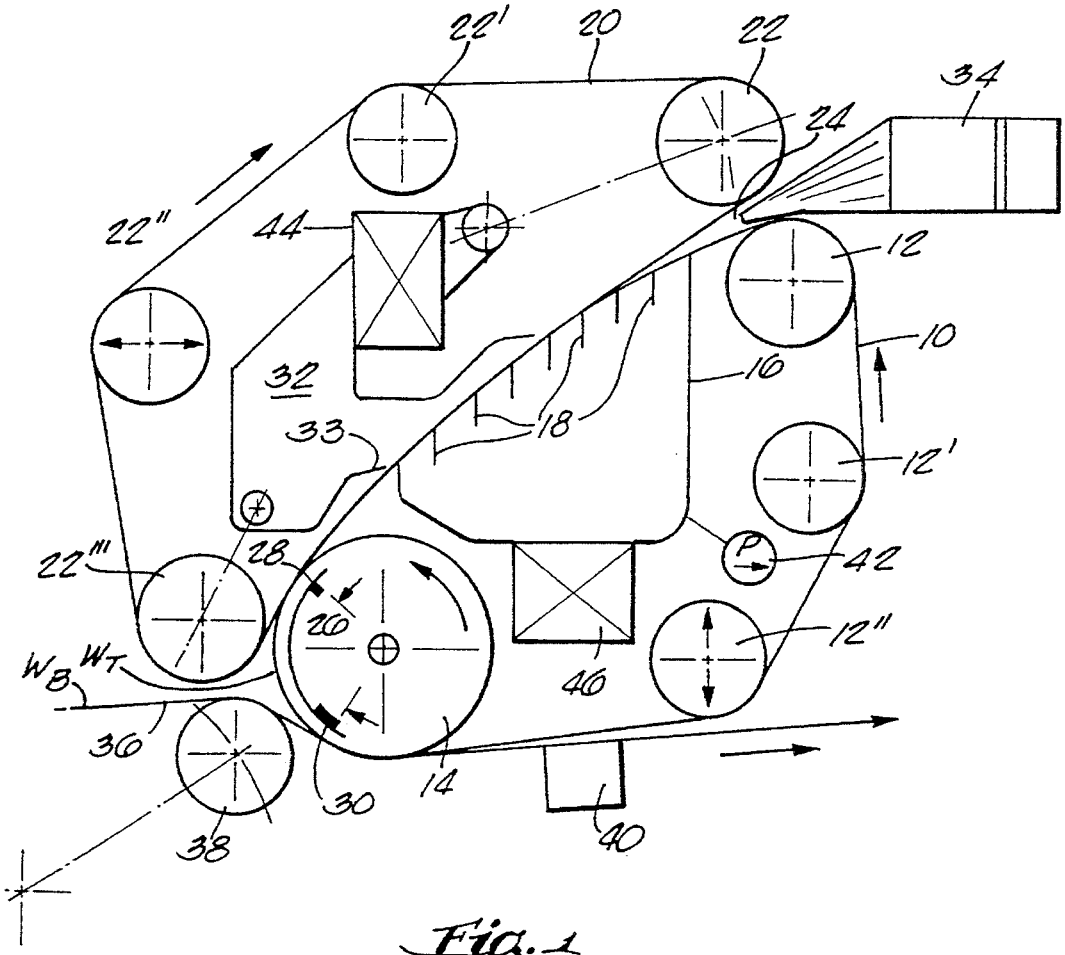
FIG. 1 is a side-elevational view of the former showing a foil box within the first wire for substantially the length of the forming zone between the throat and the turning roll.

As shown in FIG. 1, a first, lower looped top ply forming wire 10 is shown looped about guide rolls 12,12',12" and turning roll 14. Disposed within the first forming wire is a foil box 16 which has an outer contour defined by a plurality of foils 18 arranged to distend the first forming wire in a concave downwardly, (viewing the inner surface of the looped forming wire) or convex upwardly, shaped curve which defines a forming zone extending substantially between guide roll 12 and turning roll 14.

Disposed above the first, lower forming wire 10 is a looped second, upper forming wire 20 which is directed to travel in its looped path by guide rolls 22,22',22" and 22'''.

Guide rolls 12,22 direct their respective forming wires 10,20 into a throat 24 which converges near the leading edge of foil box 16. In the embodiment shown in FIG. 1, the throat 24 extends to just after the beginning of foil box 16.

The second forming wire 20 is guided to remain over the first forming wire for a short circumferential distance over the surface of turning roll 14. Turning roll 14 is a suction roll having a vacuum chamber 26 extending between circumferentially spaced seals 28,30. The first and second forming wires are shown engaged for a short distance past the upstream vacuum chamber seal 28.

Positioned within the looped second forming wire 20 is a save-all 32, which can take the form of a so-called auto-slice. In either configuration, the save-all or auto-slice represents a blade, lip or slot 33 which is positioned in closely spaced adjacency, or even non-pressure contact, with the inner side of looped forming wire 20. More than one such lip or slot 33 may be used.

A headbox 34 is positioned to direct an aqueous slurry of stock fibers into the throat 24. Depending on operating parameters, such as machine speed, stock consistency and, possibly, the type of forming wires used, the headbox slice nozzle may be directed slightly toward one or the other of the forming wires.

Beneath the top ply former, which is the designation for the apparatus just described, is a base ply forming wire 36 on which a base ply web $W_B$ has been formed upstream of the top ply former by other means. A pivoted guide roll 38 wraps the base ply forming wire 36 around a portion of the periphery of the turning roll 14 beginning at a point over the trailing seal 30. The top ply web $W_T$ is thus brought into co-running engagement with the base ply web $W_B$, and ply-bonding occurs between the webs during this period of contact. Transfer of the composite, multi-ply paper sheet so formed to the base ply wire 36 is assured by the application of vacuum pressure in transfer box 40.

A source of sub-atmospheric air pressure 42 is optionally linked to the foil box 16 to provide vacuum pressure to the lower side of the web being formed between the co-running forming wires 10,20 over the foil blades 18 in the foil box. Water is removed from the inner side of the looped second forming wire by a drain 44, and water is removed from within the looped first forming wire by drain 46.

Figure 2:
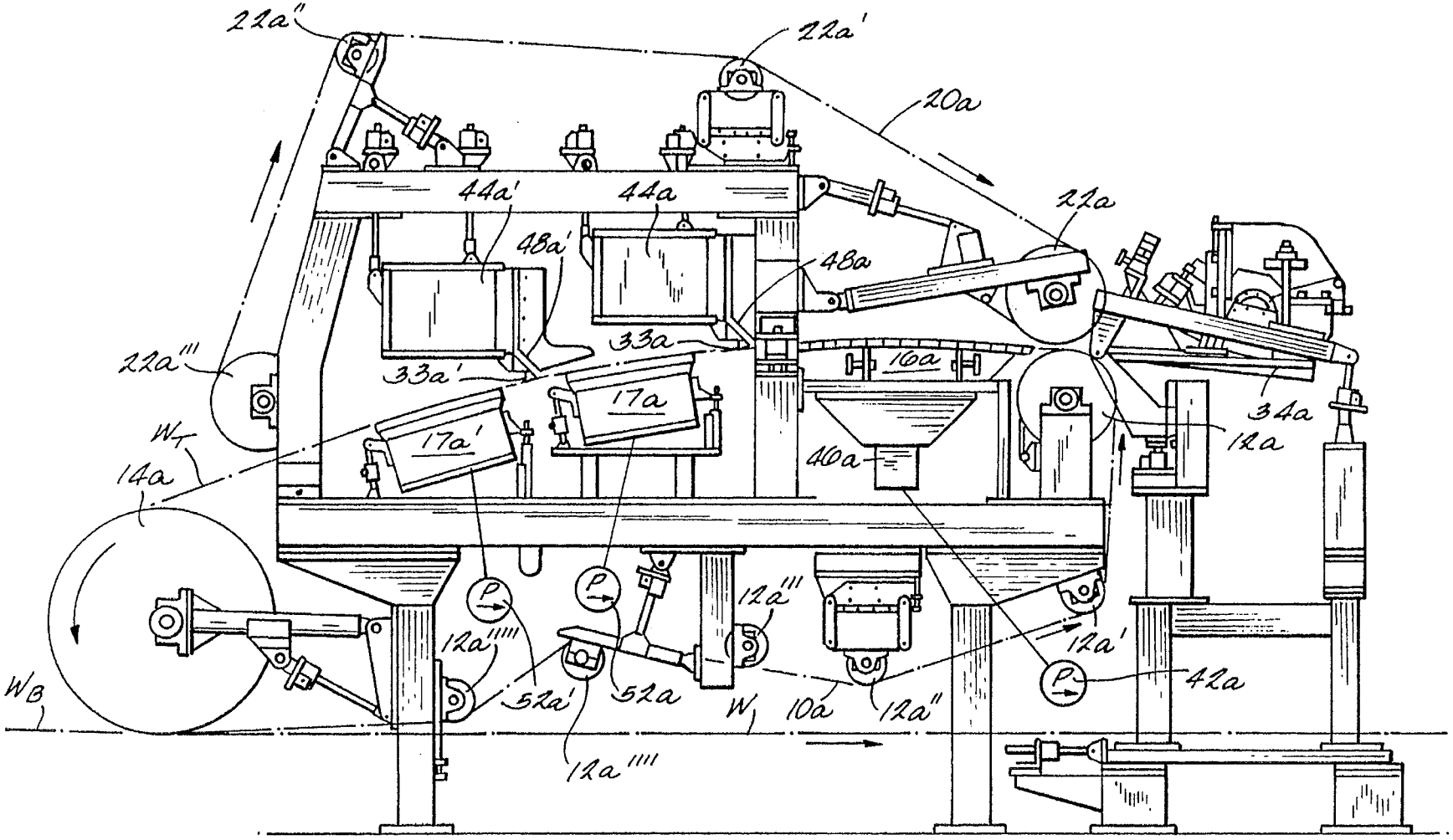
FIG. 2 is a side-elevational view of the former showing a foil box followed by two suction boxes within the first, or lower, top ply forming wire.
Figure 3:
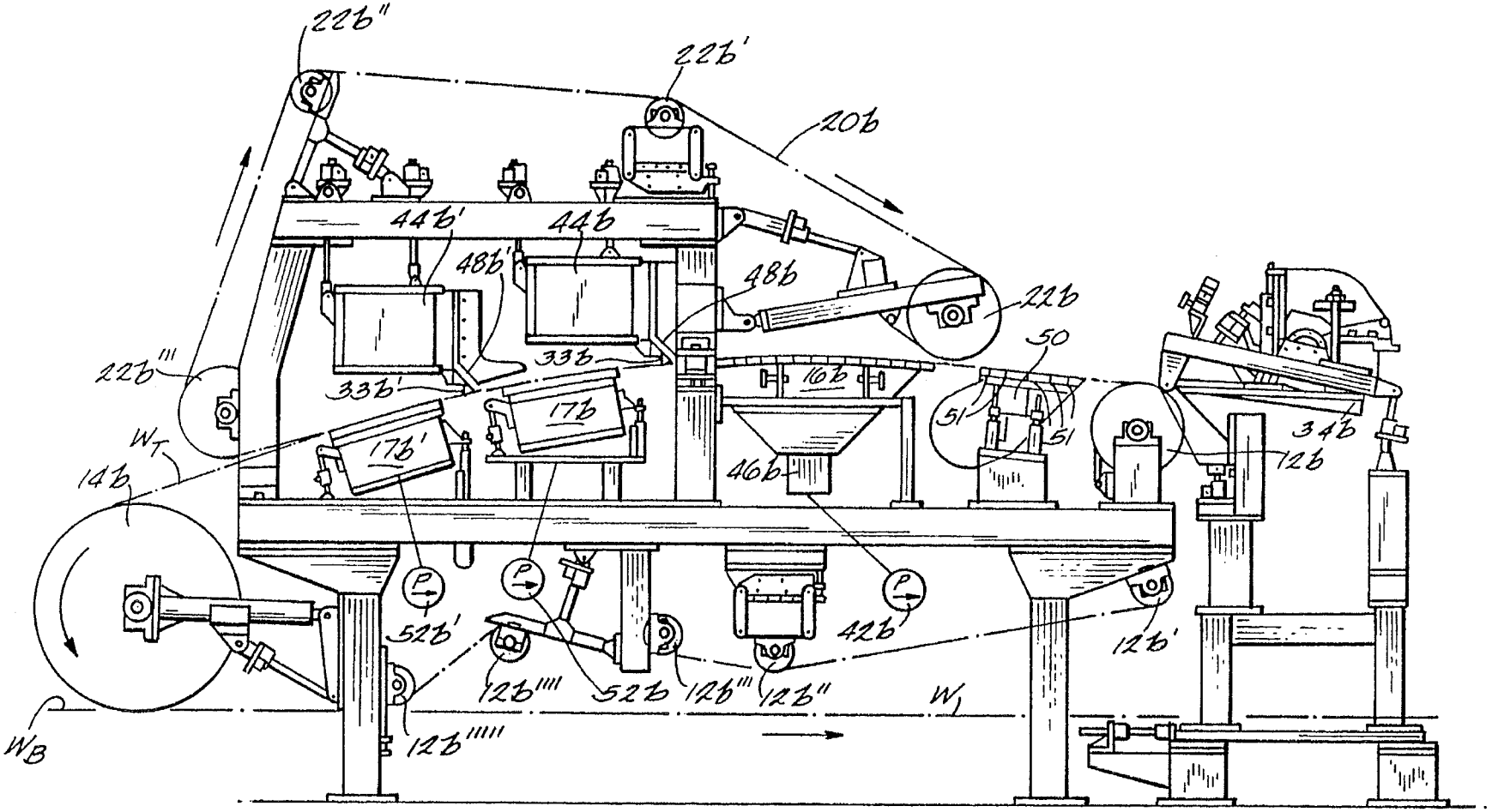
FIG. 3 is a side-elevational view, similar to that shown in FIG. 1, but including a forming shoe within the lower top ply forming wire upstream of where the second, or upper, top ply forming wire comes into co-running engagement with the web over the first forming wire.

In the various configurations shown in FIGS. 1–3, corresponding elements in each figure will be correspondingly numbered with a letter postscript to distinguish between corresponding elements in the various figures. Similarly, like elements within a particular figure will be distinguished by a different number of prime superscripts after each element number.

As shown in FIG. 2, the dewatering elements within the first forming wire 10*a* comprise a foil box 16*a*, and two vacuum boxes 17*a*,17*a'* The last forming box 17*a'*, in the downstream direction, effects the transfer of the newly formed top ply web $W_T$ onto the first forming wire.

Within the looped second forming wire 20*a*, is a first auto-slice 48*a* following the foil box, and a second auto-slice 48*a'* intermediate the two vacuum boxes 17*a*,17*a'*. Both auto-slices have a leading lip 33*a*,33*a'* which is mounted in closely spaced adjacency, or non-pressure contact, with the inner side of looped forming wire 20*a*. A headbox 34*a* discharges an aqueous stock fiber stream into the throat 24*a* formed between the forming wires 10*a*,20*a* converging over guide rolls 12*a*,22*a*.

Turning roll 14*a*, which in this configuration is a plane surfaced roll with no vacuum chamber, brings the first forming wire around its surface and into co-running engagement with the base ply web $W_B$ being carried on base ply forming wire 36*a*.

In the embodiment shown in FIG. 3, a blade forming shoe 50 has been mounted within the first forming wire 10*b* upstream of the foil box 16*b*. The second forming wire 20*b* is brought into engagement with the web over the first forming wire 10*b* just prior to the beginning of their co-running travel over the foil box 16*b*. The first forming wire is guided onto the leading edge of foil box 16*b* by a guide roll 12*b*. The headbox 34*b* discharges an aqueous slurry of stock onto the first forming wire over the surface of guide roll 12*b*. As in the embodiment shown in FIG. 2, the second vacuum box 17*b* effects the transfer of the newly formed top ply web $W_T$ onto the first forming wire which is directed into ply-bonding contact with the base ply web $W_B$ to form the multi-ply web W in a manner similar to that described in conjunction with FIG. 2.

While the cross-sectional profile of the first forming wire contour over blade forming shoe 50, or forming board, may be substantially planar, or concave downward, (from the perspective of viewing the inner surface of the first forming wire 10*b* over forming shoe 50) the overall contour of the forming zone extending from before the leading edge of the forming shoe 50 to the trailing edge of vacuum box 17*b'* is concave downwardly (inner surface of the first forming wire)/convex upwardly (outer surface of the first forming wire) as shown which is similar to the configurations shown in FIGS. 1 and 2. The vacuum pressure beneath forming wire 10*b* is zero or low, regardless of how it is induced, so as to promote better formation, and improved web properties, such as directional strength.

In the embodiments shown in FIGS. 2 and 3, foil boxes 16*a*,16*b* and vacuum boxes 17*a*,17*a'*,17*b* and 17*b'* are connected to a source of sub-atmospheric air pressure which are designated generally as 52*a*,52*a'*,52*b* and 52*b'*. The profile contours of the wire-contacting surfaces of the foil boxes and vacuum boxes is concave downwardly (inner surface of the first forming wire 10*a*, 10*b*) /convex upwardly. (outer surface of the first forming wire 10*a*, 1O*b*). While the surface of the foil boxes is defined by a series of spaced foils which are parallel and spaced in the machine direction and which extend in the cross-machine direction, the contours of the vacuum boxes are usually comprised of an arcuate surface which is perforated, such as with holes drilled through their covers, which permit the application of vacuum pressure to the underside of the first looped forming wire.

In operation, with particular reference to FIGS. 1 and 2, the headbox discharges an aqueous stock slurry into the throat between the co-running forming wires. Since the only application of sub-atmospheric air pressure to the fibrous stock slurry between the forming wires is provided by the foil box or vacuum boxes beneath the first forming wire 10,10*a*,10*b*, water is urged from the stock slurry outwardly and downwardly through the lower top ply web $W_T$ to within the looped first forming wire. Due to the tension of the second forming wire 20,20*a*,20*b* over the stock slurry over the first forming wire water is expressed outwardly through the top ply web $W_T$ being formed between the first and second forming wires and into the save-all 32, or auto-slices 48*a* ,48*a*', 48*b*,48*b*'. The water is also urged outwardly through the upper surface of the top ply web by centrifugal force and the force of gravity in the slightly down-turning portions of co-running forming wire travel in the generally horizontally disposed, concave downwardly forming zone (from the perspective of viewing the inner surface of the lower forming wire 10,10*a*,10*b* over the forming zone). The blades in the foil box 16,16*a*,16*b*, operating with or without sub- atmospheric vacuum pressure, urge the water gently to within the foil boxes. Downstream, at a point where the web is more dewatered, higher sub-atmospheric vacuum pressure is applied to vacuum boxes 17*a*',17*b*' to further dewater the top ply web through the lower surface thereof.

In the embodiment shown in FIG. 3, the headbox discharges the stock slurry onto the first forming wire and additional dewatering through the lower surface of the top ply web is effected by the blades 51 contacting the inner surface of the first forming wire over the forming shoe 50. This is substantially similar to the water removal operation at the beginning of a conventional fourdrinier.

In all of the embodiments, the application of sub-atmospheric air pressure solely to the lower side of the top ply web through the first forming wire urges the fines and any fillers in the stock slurry to migrate downwardly toward the lower surface of the top ply web. Thus, while some of the fines near the lower surface of the top ply web over the first forming wire are removed from the web, a relatively large proportion of the fines initially near the upper surface of the top ply web adjacent the second forming wire remain in the web during the dewatering effected by the sub-atmospheric air pressure. Not only do these fines remain in the web, but a relatively larger total proportion of the fines initially in the stock remain in the web due to the absence of any application of sub-atmospheric air pressure to the stock slurry between the forming wires through the second forming wire. In other words, the only forces urging water out of the upper surface of the top ply web are centrifugal force, forming wire tension and, in the slightly downwardly extending portion of forming wire travel in the substantially horizontally disposed forming section, gravity. Water expressed through the top (second) forming wire, therefore, need only be collected by the save-all or auto-slices; it is not urged through the top wire by these elements.

Thus, a relatively higher proportion of fines remain in the upper surface of the top ply web being formed, and it is this surface which is brought into ply-bonding contact with the upper surface of the base ply web $W_B$ over the turning roll. Since ply-bonding is enhanced by a higher proportion of fines in the surface of one, or both, of the webs at their interface, ply-bonding between the top ply web $W_T$ and the base ply web $W_B$ is promoted by this invention. This allows ply-bonding to be achieved at lower web moisture levels and faster machine speeds, or some combination of both.

In this invention, both upward (through the second forming wire) and downward (through the first forming wire) dewatering is effected, but the dewatering is controlled as described. More fines remain at or near the top surface of the top ply web for better ply bonding, and more fines and fibers remains in the whole top ply web due to the application of sub-atmospheric pressure on only the lower side through the first forming wire. In other words, the bottom of the top ply web is also of a higher quality. This promotes good top ply smoothness and printing properties in the composite multi-ply web W.

Naturally, variations in the method and apparatus described can be made without departing from the spirit of the invention and scope of the claims. For example, the throat can extend from upstream of the place where the top ply forming wires are guided to travel in substantially the same direction to where the wires converge. Also, while the foil boxes, and forming shoe, have been described as operated in conjunction with sub-atmospheric air pressure, it is contemplated that, under certain circumstances, they need not be so operated. Finally, it is to be understood that the terms web, sheet and paper include the term board.

We claim:

1. A method for forming a multi-ply web, comprising the steps:

forming a base ply web on a traveling foraminous base forming wire;

bringing first and second looped forming wires into co-running engagement in a forming zone extending between a guide roll and a turning roll disposed within the first looped forming wire wherein the overall, substantially continuous contour of the forming zone has the first forming wire having an inner surface curved concave downwardly, and the second forming wire having an inner surface curved convex upwardly path of travel;

projecting an aqueous top ply stock stream onto one or the other, or both, of the first and second looped forming wires and into a throat formed by the converging first and second forming wires;

dewatering the top ply stock stream through the first forming wire by applying sub-atmospheric air pressure to the stock stream solely beneath its concave downwardly path of travel to thereby form a lower web surface of a top ply web;

expressing water upwardly through the second forming wire over its path of travel solely by wire tension and centrifugal force to thereby form an upper web surface of the top ply web;

collecting the water expressed through the second forming wire within the second forming wire at one or more locations above the convex upwardly curved inner surface of the second forming wire;

bringing the upper web surface of the top ply web into co-running engagement with the base ply web to effect ply-bonding therewith to form a multi-ply web.

2. Apparatus for forming a multi-ply paper web, comprising, in combination:

a guide roll and a turning roll rotatably mounted in the apparatus;

a looped base ply forming wire for carrying and dewatering a base ply web;

first and second looped top ply forming wires arranged to converge in a throat and travel in co-running engagement wherein the overall, substantially continuous contour of the forming zone extending between the guide roll and the turning roll has the first forming wire having an inner surface curved concave downwardly, and the second forming wire having an inner surface curved convex upwardly path of travel together;

headbox means for depositing an aqueous top ply stock slurry into the throat to initiate formation of a top ply web having lower and upper surfaces;

sub-atmospheric air pressure dewatering apparatus located solely within the first top ply forming wire for dewatering the top ply stock stream downwardly therethrough and forming a top ply web having its lower surface on the first forming wire;

means for receiving water expressed upwardly and inwardly through the second looped forming wire solely by centrifugal force and forming wire tension, the upper surface of the top ply web facing the second wire, the means for receiving the water located at one or more locations above the convex upwardly curved inner surface of the second forming wire;

guide means for guiding the second forming wire away from the first forming wire, the apparatus arranged so that the upper surface of the top ply is dewatered upwardly solely by centrifugal force and forming wire tension;

said turning roll arranged for directing the first forming wire and web into co-running engagement with the base ply web to effect ply bonding between the upper surface of the top ply and the base ply web.

* * * * *

UNITED STATES PATENT AND TRADEMARK OFFICE

CERTIFICATE OF CORRECTION

PATENT NO. : 5,468,348

DATED : November 21, 1995

INVENTOR(S) : James Blackledge, Nazzareno Salvai and James A. Turner

It is certified that error appears in the above-indentified patent and that said Letters Patent is hereby corrected as shown below:

Column 2, lines 62 & 64: "$\cdot^{\bullet}\overset{-}{\bullet}$" should read --$\frown$ --.

Signed and Sealed this

Eleventh Day of June, 1996

*Attest:*

Bruce Lehman

BRUCE LEHMAN

*Attesting Officer*

*Commissioner of Patents and Trademarks*